United States Patent [19]

Fera

[11] 4,373,236

[45] Feb. 15, 1983

[54] ONE-PIECE BUCKLE AND KEEPER ASSEMBLY

[75] Inventor: Victor Fera, Lincoln, R.I.

[73] Assignee: Sage Manufacturing Co., Inc., Providence, R.I.

[21] Appl. No.: 203,547

[22] Filed: Nov. 3, 1980

[51] Int. Cl.[3] ..... B21C 35/04; B21C 37/02; B21D 53/46

[52] U.S. Cl. ..... 29/3; 72/379

[58] Field of Search ..... 24/307, 308, 320, 321; 29/3; 72/379, 338, 414

[56] References Cited

U.S. PATENT DOCUMENTS

| | | | |
|---|---|---|---|
| 1,088,408 | 2/1914 | Eichberg | 24/308 |
| 1,267,591 | 5/1918 | Rehbein | 72/414 |
| 1,523,041 | 1/1925 | Simmons | 24/321 |
| 1,795,559 | 3/1931 | Hellmann | 29/3 |
| 1,882,369 | 10/1932 | Russell | 29/3 |
| 2,481,179 | 9/1949 | Turini | 29/3 |
| 3,119,432 | 1/1964 | Rogers | 72/414 |
| 3,575,034 | 4/1971 | Lightner | 72/379 |

FOREIGN PATENT DOCUMENTS

| | | | |
|---|---|---|---|
| 7905417 | 9/1980 | France | 72/379 |
| 505378 | 5/1939 | United Kingdom | 29/3 |

*Primary Examiner*—Donald R. Schran
*Assistant Examiner*—Paul M. Heyrana, Sr.
*Attorney, Agent, or Firm*—Salter & Michaelson

[57] ABSTRACT

A method of manufacturing a one-piece buckle and keeper assembly from a flat metal strip by using an automatic progressive tool, wherein the strip is stamped at a series of stations to cut and form the edges and contours of the one-piece buckle and keeper assembly thereon, the outwardly extending arm of the keeper are bent upwardly and inwardly to form a closed keeper loop and then a tongue is pivotally attached to the buckle after which the fully formed buckle, keeper and tongue assembly is cut from the strip.

5 Claims, 4 Drawing Figures

ONE-PIECE BUCKLE AND KEEPER ASSEMBLY

BACKGROUND OF THE INVENTION

The present invention relates to a method of manufacturing a one-piece buckle and keeper assembly.

Prior to this invention, buckles and keepers were manufactured as separate parts which were assembled by bending or rolling connecting arms attached to the keeper around one end of the buckle. Subsequently, a buckle tongue was pivotally attached to the buckle between the points of attachment of the connecting arms.

With the method of the present invention, the buckle and keeper are manufactured as a single unit. The finished buckle and keeper assembly hereby manufactured has essentially the same appearance as that of the prior art but it is a one-piece unit, thereby eliminating the separate step of connecting the keeper to the buckle. As a result, the product made by the method of the instant invention is stronger and can be manufactured more quickly, easily and economically.

The step of attaching the keeper to the buckle previously required substantial care and time. The connecting arms of the keeper had to be bent with precision to secure their attachment to the buckle and often they had to be soldered to the buckle to assure a rigid connection thereto, and to prevent relative slippage. By eliminating this step, the method of the present invention not only saves much of the time and expense of past methods, but also results in a better product because the keeper and buckle are positively integrated.

SUMMARY OF THE INVENTION

The present invention relates to a method of manufacturing a one-piece buckle and keeper assembly from a flat metal strip. An automated progressive die tool is used to stamp the flat metal strip to form the contours of a one-piece buckle and keeper assembly thereon and also to remove or blank out portions of the strip to define the edges of the buckle and keeper assembly. The keeper is then formed to a closed loop by upwardly and inwardly bending the keeper arms thereby providing a fully formed buckle and keeper assembly. The buckle and keeper assembly is then cut from the metal strip by the progressive tool after a tongue has been pivotally attached to the buckle by conventional buckle attachment apparatus.

DESCRIPTION OF THE DRAWING

In the drawings which illustrate the best mode presently contemplated for carrying out the present invention.

DESCRIPTION OF THE INVENTION

Figure 1:
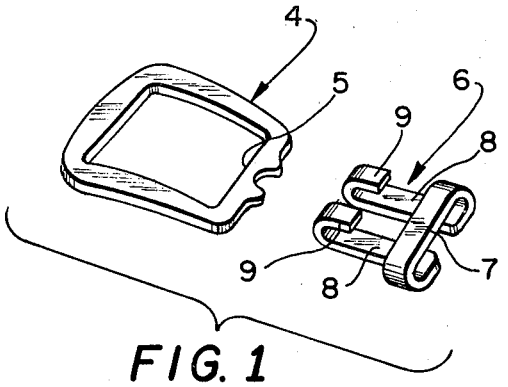
FIG. 1 PRIOR ART
FIG. 1 is an exploded perspective view of a prior art buckle and keeper before the keeper is attached to the buckle.
Figure 2:
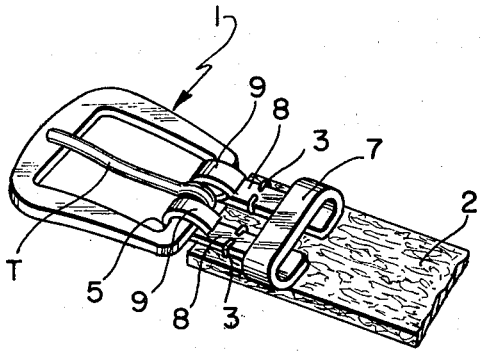
FIG. 2 PRIOR ART
FIG. 2 is a perspective view of a completed prior art buckle, keeper, and tongue assembly shown attached to a belt.

Referring now to the drawings, the buckle and keeper assembly of the prior art is shown in FIGS. 1 and 2. A fully formed buckle and keeper assembly is shown generally at 1 of FIG. 2 and is attached to a belt 2 by any suitable means such as staples 3. As will be noted from FIG. 1, the assembly of the prior art consists of a buckle 4 having a pivot bar 5 and a keeper 6 having a partially closed keeper loop 7 and a pair of keeper arms 8, the ends of which have been reversely bent to form links 9. The keeper is secured to the buckle by carefully bending links 9 around pivot bar 5 and a buckle tongue T is pivotally attached thereto between links 9 to complete the assembly shown in FIG. 2.

As may be noted, with the buckle and keeper assembly of the prior art, the keeper was attached to the buckle in a separate step by bending links 9 around pivot bar 5 of the buckle. This step was generally done with a foot press and required substantial care and time to effectively provide a rigid connection therebetween. Often times the links and the keeper arms had to be soldered to the pivot bar to prevent movement therebetween. The product made by the method of the instant invention is an integral one-piece assembly and therefore a rigid connection between the buckle and the keeper is always assured while much of the time and expense of manufacturing the assembly is eliminated.

Figure 3:
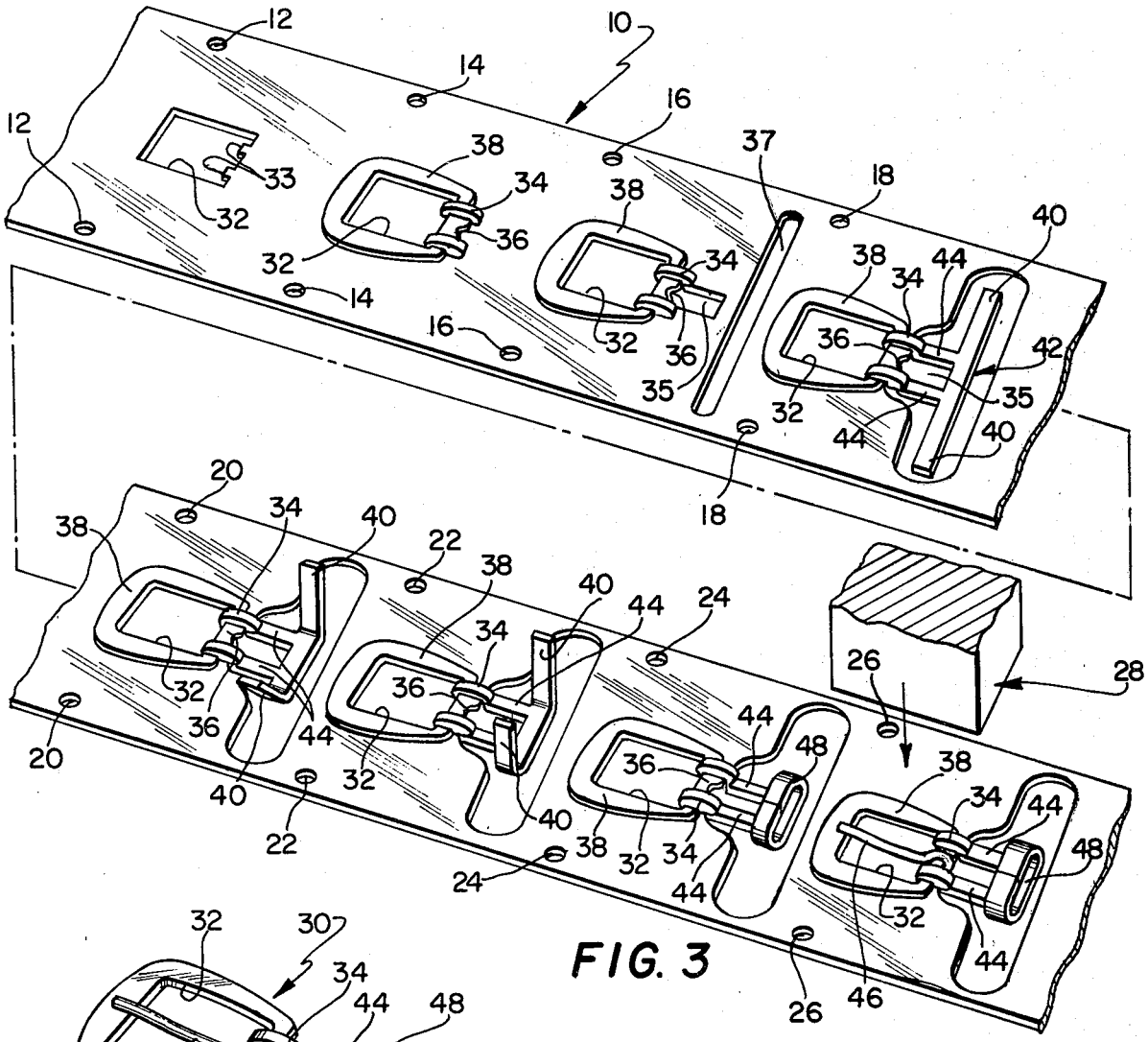
FIG. 3 is a perspective view of a metal strip sequentially illustrating the progressive formation of an integrated buckle and keeper assembly in accordance with the instant invention.
Figure 4:
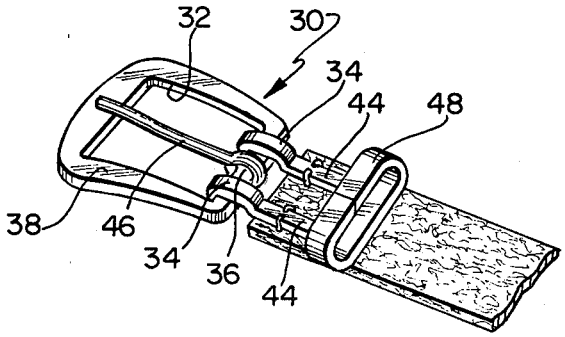
FIG. 4 is a perspective view of a one-piece buckle keeper assembly with the tongue attached thereto manufactured by the method of the instant invention and shown attached to a belt.

Referring to FIG. 3 of the drawings, a flat metal strip is shown generally at 10 having a series of pairs of equally spaced holes 12, 14, 16, 18, 20, 22, 24 and 26 adjacent to its outer edges, each pair of holes defining a work station where a progressive die stamping tool, one of which is shown generally at 28, is used to either cut, form, mold or bend various portions of the buckle and keeper assembly to make the final assembly shown generally at 30 in FIG. 4.

In the first step of manufacturing the assembly, the strip is positioned at a die stamping station with locating holes 12. The strip is stamped with a press to cut and remove the interior portions of the buckle thereby defining its interior edges 32. The interior configuration of the buckle is substantially rectangular with two small tabs 33 protruding from one transverse end thereof. In the second step of manufacturing the assembly, the strip is located at a second die stamping station by holes 14 and here a die engages the metal strip to form the contours of a buckle and keeper assembly thereon. The outer perimeter of the buckle 38 is formed on the sheet and is defined by arcuate lines following generally the rectangular configuration of the inner edge 32 of the buckle previously formed. The buckle as formed in this step has a pivot bar 36 with embossments 34 which encompass the tabs 33 and which are formed to simulate the connecting end portions of the arms of a prior art keeper assembly as shown in FIG. 2. The strip is then positioned by locating holes 16 at a third die stamping station where further interior and exterior portions of the keeper assembly are cut and removed from the strip as shown at 35 and 37 in FIG. 3 of the drawings. The strip is then moved to a fourth station and there located by holes 18. Here the final exterior portions of the keeper assembly are cut and removed from the strip with the outlines of the keeper being fully defined as shown generally at 42. Connecting arms 44 are here defined as extending longitudinally along the sheet in attachment with the raised embossments 34 of the buckle. The keeper bar 42 is also here defined and extends transversely across the strip to define outwardly extending ends 40. As will be seen, bar 42 is connected to the buckle 38 by connecting arms 44. In the fifth step, the strip is positioned at a die stamping station by means of locating holes 20 and at this station the outwardly extending ends 40 of the keeper bar 42 are bent upwardly initiating the formation of the keeper loop 48. The strip is then moved to station 6 being there located by holes 22 and the outwardly extending arms 40 of the keeper bar are bent upwardly to a position substantially perpendicular to the strip. The strip is then advanced to the next or seventh station and is there located by holes 24. Here the keeper loop is completed as the arms 40 of the keeper bar are bent inwardly meeting at seam 47 to form a closed keeper loop 48. Finally, the strip is advanced to an eighth station and there located by holes 26. Here the strip is engaged by tool 28 to remove the fully formed buckle and keeper assembly therefrom by cutting around the outer perimeters of the buckle. Prior to this severing step, a conventional buckle tongue 46 is pivotally attached to pivot bar 36 by conventional apparatus, tongue 46 extending across the interior open portion of the buckle and overlying the portion of the buckle opposite pivot bar 36. As may be noted from FIG. 4 of the drawings, tongue 46 is positioned on the same side of the buckle and keeper assembly as keeper loop 48. The buckle and keeper assembly is then complete and ready to be fastened to a belt or other strap as shown at 50 in FIG. 4. It will be noted that the loop 48 defines a complete enclosure as compared to loop 7 of the prior art, which necessarily has an open portion 52 on its bottom side. In this connection it has been found that the completely enclosed loop of the present invention is advantageous in that it provides a smoother bearing or support for the belt or strap that passes therethrough.

It will therefore be seen that the instant invention automatically provides a unitary integrated buckle and keeper assembly 30 by utilizing an automatic progressive tool thereby resulting in a simpler and more economically feasible manufacturing process, while at the same time producing an end product that has certain advantages over prior art assemblies, for the reasons hereinbefore stated.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of manufacturing a buckle and keeper assembly from a flat metal strip with an automated progressive die tool comprising the steps of:

(a) stamping said strip to cut and remove portions therefrom necessary to define the interior edges of a buckle having a transverse pivot bar and a pair of tabs which project slightly inwardly from said pivot bar;

(b) stamping said strip to form the contours of a one-piece buckle and keeper assembly thereon which includes a pair of raised embossments which encompass said tabs and simulate discrete connecting arms which have been bent around said pivot bar to effect their attachment thereto;

(c) stamping said strip to cut and remove portions therefrom necessary to define the interior and exterior edges of a flat unformed keeper assembly comprising a laterally extending keeper bar and a pair of arms which extend integrally from said raised embossments to said keeper bar;

(d) bending the outwardly extending ends of said keeper bar upwardly and inwardly to form a keeper loop; and (e) stamping said strip to remove said buckle and keeper assembly therefrom.

2. The method of claim 1 further comprising pivotally attaching a tongue to said buckle between said connecting arms, said tongue extending across the open interior portion of said buckle and overlying the opposite member thereof.

3. The method of claim 2 further characterized in that said tongue and said keeper loop are positioned on the same side of said assembly.

4. In the method of claim 3, the ends of the keeper bar meeting to form a closed keeper loop located at substantially the longitudinal center line of said buckle and keeper assembly.

5. In the method of claim 3, the contours of portions of said connecting arms being raised above the plane of said buckle to simulate the attachment of discrete keeper connecting arms thereto.

* * * * *